US009765765B2

(12) United States Patent
Ishikawa et al.

(10) Patent No.: US 9,765,765 B2
(45) Date of Patent: Sep. 19, 2017

(54) THREE-BORE VARIABLE DISPLACEMENT COMPRESSOR WITH A SWASH PLATE HAVING AN ADJUSTABLE INCLINE

(71) Applicant: SANDEN CORPORATION, Isesaki-shi (JP)

(72) Inventors: Tsutomu Ishikawa, Isesaki (JP); Anri Enomoto, Isesaki (JP); Yukihiko Taguchi, Isesaki (JP)

(73) Assignee: SANDEN HOLDINGS CORPORATION, Isesaki-shi (JP)

( * ) Notice: Subject to any disclaimer, the term of this patent is extended or adjusted under 35 U.S.C. 154(b) by 367 days.

(21) Appl. No.: 14/377,119

(22) PCT Filed: Jan. 31, 2013

(86) PCT No.: PCT/JP2013/052225
§ 371 (c)(1),
(2) Date: Aug. 6, 2014

(87) PCT Pub. No.: WO2013/118637
PCT Pub. Date: Aug. 15, 2013

(65) Prior Publication Data

US 2014/0377087 A1 Dec. 25, 2014

(30) Foreign Application Priority Data

Feb. 6, 2012 (JP) ..... 2012-022799

(51) Int. Cl.
*F04B 27/18* (2006.01)
*F04B 27/08* (2006.01)
(Continued)

(52) U.S. Cl.
CPC ..... *F04B 27/1804* (2013.01); *F04B 27/0891* (2013.01); *F04B 27/0895* (2013.01);
(Continued)

(58) Field of Classification Search
CPC .. F04B 27/1804; F04B 53/18; F04B 27/0891; F04B 27/1045; F04B 27/0895;
(Continued)

(56) References Cited

U.S. PATENT DOCUMENTS 5,183,394 A * 2/1993 Fujii ..... F04B 27/12 417/269
5,588,807 A 12/1996 Kimura et al.
(Continued)

FOREIGN PATENT DOCUMENTS

CN 1332321 1/2002
JP 06-299958 10/1994
(Continued)

OTHER PUBLICATIONS

Office Action dated Feb. 24, 2017 which issued in the corresponding German Patent Application No. 112013000858.0.

*Primary Examiner* — Essama Omgba
*Assistant Examiner* — Stephen Mick
(74) *Attorney, Agent, or Firm* — Cozen O'Connor

(57) ABSTRACT

Variable displacement compressor, with center bore 101*b* in a center part of cylinder block 101, includes: first bore 101*b*1 supporting plain bearing 131 of drive shaft 110; second bore 101*b*2 with a peripheral wall radially outside of first bore 101*b*1; and third bore 101*b*3 connected to a crank chamber and radially outside of a first bore 101*b*1. A pressure supply path 145 for flowing a part of a discharge refrigerant from a discharge chamber to the crank chamber includes: second bore 101*b*2; a first path 145*a* communicating second bore 101*b*2 with the discharge chamber; a second path 145*b* that communicates with second bore 101*b*2, and axially extends from one end surface of drive shaft 110 toward the inside of drive shaft 110; and a third path 145*c* substantially orthogonal to second path 145*b* and opens to an outer peripheral
(Continued)

surface of drive shaft 110, and communicates with the crank chamber.

9 Claims, 4 Drawing Sheets

(51) Int. Cl.
*F04B 27/10* (2006.01)
*F04B 53/18* (2006.01)

(52) U.S. Cl.
CPC ..... *F04B 27/1045* (2013.01); *F04B 53/18* (2013.01); *F04B 2027/1831* (2013.01); *F04B 2027/1845* (2013.01)

(58) Field of Classification Search
CPC ..... F04B 2027/1845; F04B 2027/1831; F04B 1/295; F04B 1/146; F04B 27/1063; F04B 27/1072; F04B 1/20; F04B 7/02; F04B 2027/1813; F04B 2027/1822; F04B 2027/1827; F04B 2027/185; Y10T 29/49236
USPC ..... 417/218, 222.1, 222.2, 270
See application file for complete search history.

(56) References Cited

U.S. PATENT DOCUMENTS

| | | | | |
|---|---|---|---|---|
| 6,283,722 | B1 * | 9/2001 | Takenaka | F04B 27/1072 417/222.2 |
| 2002/0141880 | A1 * | 10/2002 | Ahn | F04B 27/1054 417/222.2 |
| 2008/0145239 | A1 | 6/2008 | Murase et al. | |
| 2009/0178552 | A1 * | 7/2009 | Kawamura | F04B 27/1072 91/505 |
| 2010/0209261 | A1 * | 8/2010 | Lee | F04B 27/1072 417/222.1 |
| 2011/0020147 | A1 * | 1/2011 | Onda | F04B 27/1804 417/269 |
| 2012/0073430 | A1 * | 3/2012 | Uchikado | F04B 27/1054 91/183 |

FOREIGN PATENT DOCUMENTS

| | | |
|---|---|---|
| JP | 2003-301771 | 10/2003 |
| JP | 2004-218565 | 8/2004 |
| JP | 2008-106679 | 5/2008 |

* cited by examiner

THREE-BORE VARIABLE DISPLACEMENT COMPRESSOR WITH A SWASH PLATE HAVING AN ADJUSTABLE INCLINE

RELATED APPLICATIONS

This is a U.S. National stage of International application No. PCT/JP2013/052225 filed on Jan. 31, 2013. This patent application claims the priority of Japanese application no. 2012-022799 filed Feb. 6, 2012 the disclosure content of which is hereby incorporated by reference.

TECHNICAL FIELD

The present invention relates to a variable displacement compressor for use in a vehicle air conditioning system and the like.

BACKGROUND ART

Patent Document 1 discloses the following technique. In a variable displacement compressor that variably controls a refrigerant discharge rate by changing, according to a pressure in a crank chamber, an inclination angle of a swash plate connected to a drive shaft to adjust an amount of piston stroke of a compression mechanism, a pressure supply path that communicates between a discharge chamber and the crank chamber and the opening of which is adjusted by a control valve to control the pressure in the crank chamber and a pressure release path that communicates between the crank chamber and a suction chamber partially share a common path communicating with an end of the crank chamber.

REFERENCE DOCUMENT LIST

Patent Document

Patent Document 1: Japanese Patent Application Laid-open Publication No. 2003-301771

SUMMARY OF THE INVENTION

Problems to be Solved by the Invention

Oil discharged together with discharge gas is contained in the discharge chamber. With the technique described in Patent Document 1, when the control valve is opened, oil included in discharge gas flows back to the crank chamber via a gap of a bearing for radially supporting the drive shaft. This ensures the oil level in the crank chamber, and contributes to the lubrication of each portion.

However, the discharge gas flowing via the gap of the bearing is discharged near the center of the swash plate, and the oil included in the discharge gas flow does not directly spread to portions to be lubricated such as the sliding surfaces of the swash plate and shoes in the periphery. Thus, there is still room for improvement for lubrication with oil flowing from the discharge chamber back to the crank chamber.

The present invention has been made in view of such a conventional problem and provides a variable displacement compressor having improved lubricity of oil flowing from a discharge chamber back to a crank chamber.

Means for Solving the Problems

Accordingly, the present invention provides a variable displacement compressor including:

a cylinder block in which a plurality of cylinder bores arranged annually and a center bore positioned within the plurality of cylinder bores are formed;

a front housing that blocks one end of the cylinder block, and defines a crank chamber together with the cylinder block;

a valve plate that blocks the other end of the cylinder block, and in which a discharge hole and a suction hole communicating with each of the plurality of cylinder bores are formed;

a cylinder head that is provided opposite to the cylinder block with the valve plate in between, and in which one of a suction chamber and a discharge chamber is formed in a center part and the other one of the suction chamber and the discharge chamber is formed in an annular part outside the center part, the suction chamber communicating with a suction-side external refrigerant circuit, and the discharge chamber communicating with a discharge-side external refrigerant circuit;

a piston that is disposed in each of the plurality of cylinder bores, and reciprocates in an axial direction of a drive shaft;

the drive shaft, one end of which is inserted into the center bore, and that is radially supported by the cylinder block via a plain bearing;

a rotor that is fixed to the drive shaft, and rotates integrally with the drive shaft;

a swash plate that is connected to the rotor via a connecting unit, and slidably attached to the drive shaft so that the swash plate has a variable inclination angle with respect to an axis of the drive shaft when rotating synchronously with the rotor;

a conversion mechanism that converts rotation of the swash plate into reciprocation of the piston;

a pressure supply path that communicates between the discharge chamber and the crank chamber;

a control valve that adjusts an opening of the pressure supply path; and a pressure release path that communicates between the crank chamber and the suction chamber, in which a pressure in the crank chamber is changed by adjusting the opening by the control valve to change the inclination angle of the swash plate and adjust a stroke of the piston, and a refrigerant sucked into the cylinder bore from the suction chamber is compressed and discharged into the discharge chamber.

A downstream part of the pressure supply path includes: an upstream path along a center axis in the drive shaft; and a downstream path intersecting and connecting to the upstream path, and having an open end communicating with the crank chamber.

Effects of the Invention

When the control valve is opened, a part of refrigerant gas in the discharge chamber, upon reaching the downstream path from the upstream path in the drive shaft in the pressure supply path, changes direction and flows out of the opening of the downstream path. Oil included in the refrigerant bursts outward from the drive shaft and is guided toward the swash plate, due to centrifugal force in the rotating downstream path. This improves the lubrication of portions to be lubricated (sliding portions) of the swash plate (especially the swash plate on the compression stroke side).

MODE FOR CARRYING OUT THE INVENTION

The following describes embodiments of the present invention in detail.

Figure 1:
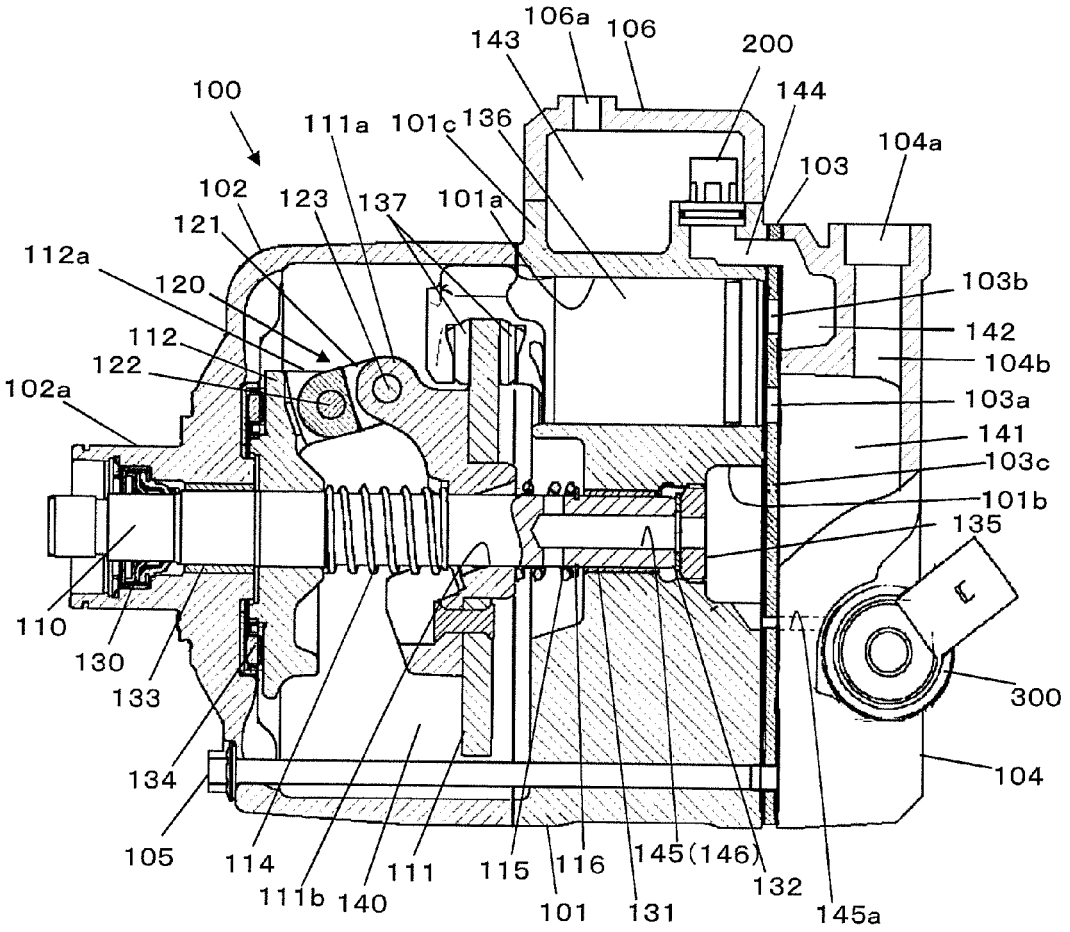
FIG. 1 is a longitudinal sectional view of a variable displacement compressor according to a first embodiment of the present invention.

FIG. 1 is a longitudinal sectional view of a compressor (in particular, a variable displacement swash plate compressor) according to an embodiment of the present invention.

A variable displacement compressor 100 is a clutchless compressor, and includes: a cylinder block 101 in which a plurality of cylinder bores 101*a* and a center bore 101*b* positioned within the plurality of cylinder bores 101*a* are formed; a front housing 102 connected to one end of the cylinder block 101; and a cylinder head 104 connected to the other end of the cylinder block 101 via a valve plate 103.

A drive shaft 110 passes through a crank chamber 140 defined by the cylinder block 101 and the front housing 102. A swash plate 111 is placed around an axial center part of the drive shaft 110. The swash plate 111 is connected, via a link mechanism 120, to a rotor 112 fixed to the drive shaft 110, and the inclination angle (angle of inclination) of the swash plate 111 with respect to the axis of the drive shaft 110 is variable.

The link mechanism 120 includes: a first arm 112*a* protruding from the rotor 112; a second arm 111*a* protruding from the swash plate 111; and a link arm 121, one end of which is rotatably connected to the first arm 112*a* via a first connecting pin 122, and the other end of which is rotatably connected to the second arm 111*a* via a second connecting pin 123.

The swash plate 111 has a through hole 111*b* shaped so that the swash plate 111 can be inclined in a range from a maximum inclination angle to a minimum inclination angle. A minimum inclination angle regulation part that contacts the drive shaft 110 is formed in the through hole 111*b*. The minimum inclination angle regulation part in the through hole 111*b* allows the swash plate 111 to be inclined to approximately 0°, where 0° is the inclination angle of the swash plate 111 when the swash plate 111 is orthogonal to the drive shaft 110. Here, "approximately 0°" denotes the range from 0° to 0.5°.

A disinclining spring 114 for biasing the swash plate 111 to the minimum inclination angle until the minimum inclination angle is reached is disposed between the rotor 112 and the swash plate 111, and an inclining spring 115 for biasing the swash plate 111 in the direction in which the inclination angle of the swash plate 111 increases is disposed between the swash plate 111 and a spring support member 116. At the minimum inclination angle, the inclining spring 115 has a larger biasing force than the disinclining spring 114. Accordingly, when the drive shaft 110 is not rotating, the swash plate 111 is positioned at an inclination angle at which the biasing forces of the disinclining spring 114 and the inclining spring 115 are balanced.

One end of the drive shaft 110 is inserted into the center bore 101*b* and supported by a plain bearing 131 in the radial direction, and one end surface of the drive shaft 110 is supported by a thrust plate 132. The other end of the drive shaft 110 is supported by a plain bearing 133 in the radial direction, and the rotor 112 fixed to the drive shaft 110 is supported by a bearing 134 in the thrust direction. The gap between the one end surface of the drive shaft 110 and the thrust plate 132 is adjusted to a predetermined gap using an adjusting screw 135.

The other end of the drive shaft 110 passes through a boss portion 102*a* protruding out of the front housing 102 and extends to the outside, and is connected to a power transmission device (not illustrated). A shaft seal device 130 is provided between the drive shaft 110 and the boss portion 102*a*, to block the inside from the outside. Power from an external drive source is transmitted to the power transmission device, enabling the drive shaft 110 to rotate synchronously with the rotation of the power transmission device.

A piston 136 is placed in each cylinder bore 101*a*. An outer peripheral part of the swash plate 111 is housed in an internal space of an end of the piston 136 protruding toward the crank chamber 140, and the swash plate 111 is interlocked with the piston 136 via a pair of shoes 137. This allows the piston 136 to reciprocate in the cylinder bore 101*a* according to the rotation of the swash plate 111.

In the cylinder head 104, a suction chamber 141 is divided therefrom and formed in a center part, and a discharge chamber 142 annularly surrounds the suction chamber 141. The suction chamber 141 communicates with the cylinder bore 101*a* via a suction hole 103*a* formed in the valve plate 103 and a suction valve (not illustrated). The discharge chamber 142 communicates with the cylinder bore 101*a* via a discharge valve (not illustrated) and a discharge hole 103*b* formed in the valve plate 103.

The front housing 102, the cylinder block 101, the valve plate 103, and the cylinder head 104 are fastened together with a plurality of through bolts 105 via gaskets (not illustrated), to form a compressor housing.

A muffler is provided on the cylinder block 101 at an upper portion thereof in the figure. The muffler is formed by fastening together a cover member 106 and a formation wall 101*c*, which is formed in the upper part of the cylinder block 101, with bolts via a seal member (not illustrated). A check valve 200 is disposed in a muffler space 143. The check valve 200 is situated in a part of connection between a communication path 144 and the muffler space 143, and operates in response to the difference in pressure between the communication path 144 (upstream side) and the muffler space 143 (downstream side). In detail, the check valve 200 blocks the communication path 144 in a case in which the pressure difference is less than a predetermined value, and releases the communication path 144 in a case in which the pressure difference is greater than the predetermined value. The discharge chamber 142 is connected to a discharge-side refrigerant circuit of the air conditioning system, through a discharge path that is formed by the communication path 144, the check valve 200, the muffler space 143, and a discharge port 106*a* in an upper wall of the cover member 106.

A suction port 104*a* and a communication path 104*b* are formed in the cylinder head 104. The suction chamber 141 is connected to a suction-side refrigerant circuit of the air conditioning system, through a suction path that is formed by the communication path 104*b* and the suction port 104*a*.

The suction path extends linearly from the radial outside of the cylinder head 104 so as to cross a part of the discharge chamber 142.

A control valve 300 is also provided in the cylinder head 104. The control valve 300 adjusts the opening of a pressure supply path 145 communicating between the discharge chamber 142 and the crank chamber 140, to control the amount of discharge gas introduced into the crank chamber 140. The refrigerant in the crank chamber 140 flows through a pressure release path 146 into the suction chamber 141. An orifice 103*c* formed in the valve plate 103 is positioned in the pressure release path 146.

The control valve 300 controls the amount of discharge gas introduced into the crank chamber 140 to change the pressure in the crank chamber 140, thereby changing the inclination angle of the swash plate 111, that is, the stroke of the piston 136. The discharge volume (discharge refrigerant flow rate) of the variable displacement compressor 100 can be variably controlled in this way.

When the air conditioner is on, that is, in the operating state of the variable displacement compressor 100, an amount of power supplied to a solenoid included in the control valve 300 is adjusted based on an external signal, to variably control the discharge volume so that the pressure in the suction chamber 141 is at a predetermined level. The control valve 300 can optimally control the suction pressure depending on the external environment.

When the air conditioner is off, that is, in the non-operating state of the variable displacement compressor 100, power to the solenoid included in the control valve 300 is stopped to forcibly release the pressure supply path 145, thus controlling the discharge volume of the variable displacement compressor 100 to the minimum.

Next, the following describes the structure of the center bore 101*b* in detail.

Figure 2:
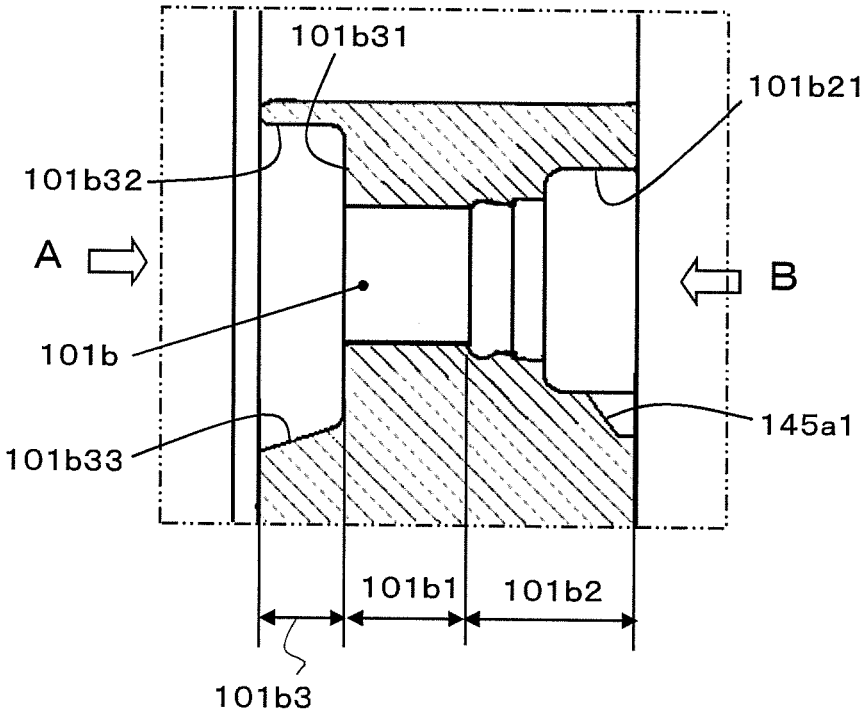
FIG. 2 is a longitudinal sectional view of a center bore formed in the compressor.
Figure 3:
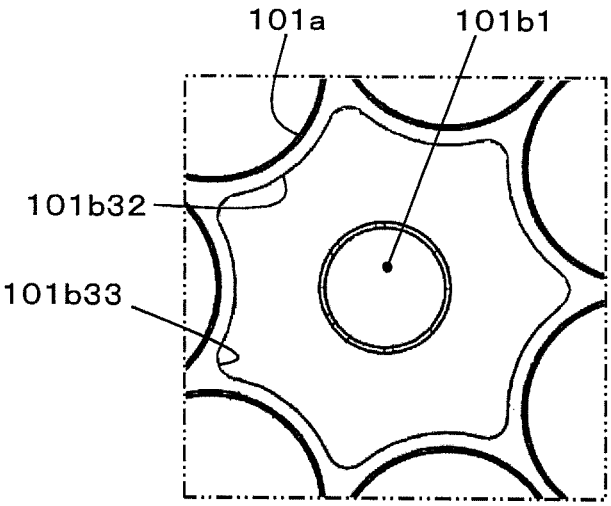
FIG. 3 is a view seen from the direction of arrow A in FIG. 2.
Figure 4:
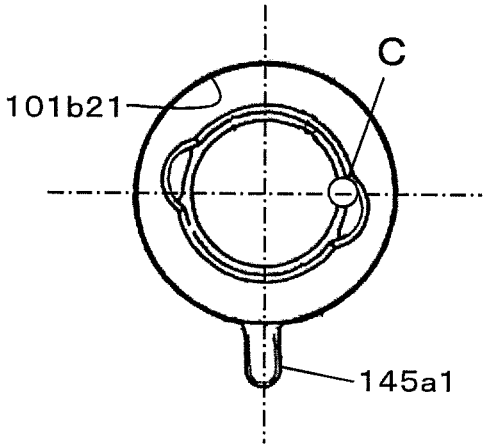
FIG. 4 is a view seen from the direction of arrow B in FIG. 2.

FIGS. 2 to 4 illustrate the center bore 101*b* and its surroundings (excluding the drive shaft 110). The center bore 101*b* formed in the cylinder block 101 includes: a first bore 101*b*1 supporting the plain bearing 131; a second bore 101*b*2 adjacent to the first bore 101*b*1 and positioned on the valve plate 103 side; and a third bore 101*b*3 adjacent to the first bore 101*b*1 and connected to the crank chamber 140.

A peripheral wall 101*b*21 of the second bore 101*b*2 on the valve plate 103 side is circular, and is radially outside of the first bore 101*b*1.

The third bore 101*b*3 is made up of a bottom wall 101*b*31 and a peripheral wall 101*b*32. The peripheral wall 101*b*32 has a plurality of curved surfaces protruding toward the drive shaft 110. The plurality of curved surfaces match the formation walls of the cylinder bores 101*a*. A recess 101*b*33 is disposed between adjacent ones of the curved surfaces, and is inclined so that its distance from the drive shaft 110 increases with decreasing distance from the crank chamber.

The peripheral wall 101*b*32 of the third bore matches the formation walls of the cylinder bores 101*a*. Hence, in design the peripheral wall 101*b*32 of the third bore is farthest from the drive shaft 110 in the radial outside.

The length of the third bore 101*b*3 in the axial direction of the drive shaft 110, that is, the depth from the end surface of the cylinder bore 101*a* on the crank chamber 140 side to the bottom wall 101*b*31, is less than the length of each of the first bore 101*b*1 and the second bore 101*b*2.

Next, the following describes the structures of the pressure supply path 145 and the pressure release path 146 in detail.

Figure 5:
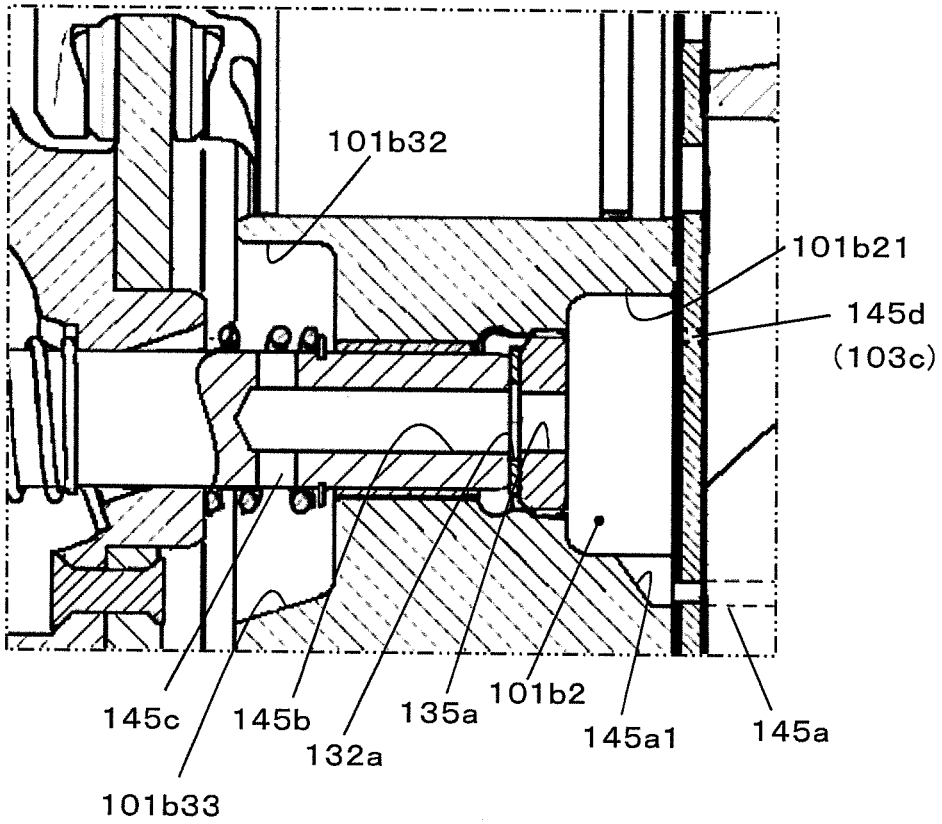
FIG. 5 is a detailed view of a pressure supply path and a pressure release path formed in the compressor and their surroundings.

FIG. 5 illustrates these paths and their surroundings. The pressure supply path 145 includes: a first path 145*a* communicating between the discharge chamber 142 and the second bore 101*b*2; the second bore 101*b*2; a through hole 135*a* formed along the center axis of the adjusting screw 135; a through hole 132*a* equally formed in the thrust plate 132; a second path 145*b* axially extending from one end surface of the drive shaft 110 toward the inside of the drive shaft 110; and a third path 145*c* substantially orthogonal to the second path 145*b* and opening to the outer peripheral surface of the drive shaft 110, and communicating with the crank chamber 140.

The control valve 300 is positioned in the middle of the first path 145*a* in the cylinder head 104 (see FIG. 1).

The first path 145*a* opening to the peripheral wall 101*b*21 of the second bore includes, at its downstream end in the cylinder block 101, a guide path 145*a*1 that is directed toward a radial center area of the second bore 101*b*2 and axially inclined to approach the open end of the second path 145*b*. The guide path 145*a*1 is appropriately positioned in consideration of the layout of the control valve 300.

The position of the third path 145*c* in the axial direction of the drive shaft 110 is in the third bore 101*b*3 and near the axial position of the end surface of the cylinder bore 101*a* on the crank chamber 140 side. The third path 145*c* has a plurality of openings to the peripheral wall 101*b*32 of the third bore.

Since the third path 145*c* opens into the third bore 101*b*3, the opening is not blocked by the swash plate 111 even when the swash plate 111 is at the minimum inclination angle.

The pressure release path 146 includes: the third path 145*c*; the second path 145*b*; the through hole 132*a* of the thrust plate 132; the through hole 135*a* of the adjusting screw 135; the second bore 101*b*2; and a fourth path 145*d* communicating between the second bore 101*b*2 and the suction chamber 141.

Thus, the third path 145*c*, the second path 145*b*, the through hole 132*a* of the thrust plate 132, the through hole 135*a* of the adjusting screw 135, and the second bore 101*b*2 constitute a common path with the pressure supply path 145, and the second bore 101*b*2 is a space of branch between the pressure supply path 145 and the pressure release path 146.

Given that the second bore 101*b*2 is a branch path, the fourth path 145*d* can be easily formed by forming a through hole in the valve plate 103 (a main body at the center, and a suction valve formation plate in which the suction valve is formed, a discharge valve formation plate in which the discharge valve is formed, and a gasket on both sides of the main body) disposed between the second bore 101*b*2 and the suction chamber 141. Though the orifice 103*c* reduced in diameter is formed in the valve plate 103 (may be formed only in the main body), the orifice 103*c* may be formed in another member constituting the fourth path 145*d*.

The open end of the fourth path 145*d* into the second bore 101*b*2 is radially inside of the peripheral wall 101*b*21 of the second bore and away from the extension area of the guide path 145*a*1 (for example, the position designated by C in FIG. 4). By such positioning, oil included in discharge gas which has flowed into the second bore 101*b*2 can be kept from directly flowing out of the fourth path 145*d*.

Next, the following describes flow of refrigerant gas in the pressure supply path 145 and the pressure release path 146 having the above-mentioned structures.

Flow of discharge gas from the discharge chamber to the crank chamber through the pressure supply path 145 is described first.

For example when the control valve 300 is opened from the closed state, flow of discharge gas from the discharge chamber 142 to the crank chamber 140 is generated, and discharge gas first flows into the second bore 101*b*2 through the first path 145*a*.

The guide path 145*a*1 is formed in the area before the opening of the first path 145*a* to the peripheral wall 101*b*21 of the second bore. Accordingly, main flow of discharge gas is guided toward the open end of the through hole 135*a* of the adjusting screw 135, and discharge gas easily flows into the second path 145*b*. The drive shaft 110 is supported by the plain bearing 131, and so the gap between the outer peripheral surface of the drive shaft 110 and the plain bearing 131 is narrow. Therefore, the discharge gas which has flowed into the second bore 101*b*2 mostly flows through the second path 145*b*.

Since the second path 145*b* is rotating, oil included in the discharge gas moves to the peripheral wall of the second path 145*b* due to centrifugation, and is sprayed from the third path 145*c* into the crank chamber 140 radially outwardly through discharge gas flow.

Since the third path 145*c* is rotating, too, the sprayed oil is partially diffused radially outwardly all around the crank chamber 140. As a result, oil is supplied to portions to be lubricated (sliding portions) in the crank chamber.

Main flow of the sprayed oil hits the peripheral wall 101*b*32 of the third bore and changes direction to the crank chamber 140, to form direct flow to the swash plate 111. This especially contributes to the lubrication of the sliding surfaces of the swash plate 111 on the compression stroke side and the shoes 137 approaching the flow in the axial direction of the drive shaft 110.

The oil which has hit the protruding curved surface of the peripheral wall 101*b*32 of the third bore partially flows into the recess 101*b*33. The oil flowing into the recess 101*b*33 forms, due to the inclined surface, direct flow to the sliding surfaces of the swash plate 111 and the shoes 137 along the discharge gas flow radially outwardly in the crank chamber 140. This contributes more to the lubrication of the sliding surfaces of the swash plate 111 on the compression stroke side and the shoes 137 (see FIGS. 3 and 5).

Here, the length of the third bore 101*b*3 in the axial direction of the drive shaft 110 is less than the length of each of the other bores (that is, the depth is smaller). Accordingly, oil which has hit the peripheral wall of the third bore 101*b*3 and changed direction to opposite from the crank chamber 140 immediately changes direction at the bottom wall 101*b*31 and returns to the crank chamber 140. Oil (mist) can thus be kept from remaining in the third bore 101*b*3, and be smoothly returned to the crank chamber 140. This ensures the oil level in the crank chamber 140, and contributes to the retention of favorable lubrication performance.

In this way, oil included in discharge gas is sprayed and diffused radially outwardly all around the crank chamber 140. The lubrication of each portion to be lubricated in the crank chamber 140 is improved as a result. In particular, the sliding surfaces of the swash plate 111 on the compression stroke side and the shoes 137 are effectively lubricated.

Next, flow of refrigerant gas from the crank chamber 140 to the suction chamber 141 through the pressure release path 146 is described.

When the control valve 300 is closed, the pressure supply path 145 is blocked, and the third path 145*c*, the second path 145*b*, the through hole 132*a* of the thrust plate 132, the through hole 135*a* of the adjusting screw 135, and the second bore 101*b*2 are switched to the pressure release path 146.

As a result, blow-by gas generated when the piston 136 compresses gas flows from the crank chamber 140 to the suction chamber 141 through the pressure release path 146. At this time, oil in the crank chamber 140 also tries to flow to the suction chamber 141 along gas flow. However, the open end of the third path 145*c* on the crank chamber 140 side connects to the third bore 101*b*3 and the oil concentration in the third bore 101*b*3 is low as compared with that in the crank chamber 140 because oil (mist) is kept from remaining in the third bore 101*b*3 as mentioned earlier, so that oil is prevented from flowing to the suction chamber 141.

In addition, the open end of the third path 145*c* on the crank chamber 140 side is rotating, which further prevents oil from flowing to the suction chamber 141.

Thus, the effect of introducing oil into the crank chamber 140 when the control valve 300 is opened (the pressure supply path 145 is opened) and the effect of preventing oil from flowing to the suction chamber 141 when the control valve 300 is closed (when the pressure release path 146 is opened) are combined to ensure oil level in the crank chamber 140 and enable effective lubrication. The amount of oil included in the refrigerant can therefore be reduced as compared with conventional compressors. In addition, oil is prevented from flowing to the suction chamber 141, i.e. flowing out of the compressor. This contributes to improved performance of the air conditioning system.

As described above, bidirectional flow is generated in the path (the third path 145*c*, the second path 145*b*, the through hole 132*a* of the thrust plate 132, the through hole 135*a* of the adjusting screw 135, and the second bore 101*b*2) common to the pressure supply path 145 and the pressure release path 146, depending on the opening of the control valve 300. The pressure in the crank chamber 140 is accordingly changed to change the inclination angle of the swash plate 111, that is, the stroke of the piston 136. The discharge volume of the variable displacement compressor 100 can be variably controlled in this way.

According to this embodiment, the downstream part of the pressure supply path 145 includes: the second path 145*b* along the center axis in the drive shaft 110; and the third path 145*c* intersecting and connected to the second path 145*b* and having an open end communicating with the crank chamber 140. Such a structure has the following effects.

When the control valve 300 is opened, a part of refrigerant gas in the discharge chamber 142, upon reaching the third path 145*c* from the second path 145*b* in the drive shaft 110, changes direction and flows out of the opening of the third path 145*c*. Oil included in the refrigerant bursts outward from the drive shaft 110 and is guided toward the swash plate 111, due to centrifugal force in the rotating third path 145*c*. This improves the lubrication of the sliding surfaces (portions to be lubricated) of the swash plate 111 (especially the swash plate on the compression stroke side) and the shoes 137.

Moreover, according to this embodiment, the position of the axis of the third path 145*c* in the axial direction of the drive shaft 110 is in the third bore 101*b*3 and near the axial position of the end surface of the cylinder bore 101*a* on the crank chamber 140 side, and the third path 145*c* opens to the peripheral wall of the third bore 101*b*3. Such a structure has the following effects.

Main flow of oil sprayed from the opening of the third path 145*c* hits the whole peripheral wall of the third bore 101*b*3 and changes direction to the crank chamber 140, to form direct flow to the swash plate 111. This contributes to the lubrication of the sliding surfaces of the swash plate 111 on the compression stroke side and the shoes 137. Since the third path 145*c* opens into the third bore 101*b*3, the opening of the third path 145*c* is not blocked by the swash plate 111 even when the swash plate 111 is at the minimum inclination angle.

Moreover, according to this embodiment, the length of the third bore 101*b*3 in the axial direction of the drive shaft 110 is less than the length of each of the first bore 101*b*1 and the second bore 101*b*2 (that is, the depth is smaller). With such a structure, oil which has hit the peripheral wall of the third bore 101*b*3 and changed direction to opposite from the crank chamber 140 immediately changes direction at the bottom wall and returns to the crank chamber 140. This ensures the oil level in the crank chamber 140.

Moreover, according to this embodiment, the inclined area, of which the distance from the drive shaft 110 increases with the decreasing distance from the crank chamber 140, is formed in the peripheral wall of the third bore 101*b*3. With such a structure, oil which has hit the peripheral wall of the third bore 101*b*3 easily flows to the crank chamber 140 radially outwardly, and easily spreads to the sliding surfaces of the swash plate 111 on the compression stroke side and the shoes 137. The lubrication of the sliding surfaces can thus be improved.

Moreover, according to this embodiment, the recess 101*b*33, of which the distance from the drive shaft 110 increases, is formed in the peripheral wall of the third bore 101*b*3, and the recess 101*b*33 is situated between adjacent ones of the cylinder bores. With such a structure, oil which has hit the peripheral wall of the third bore 101*b*3 easily flows radially outwardly, and easily spreads directly to the sliding surfaces of the swash plate 111 on the compression stroke side and the shoes 137. The lubrication of the sliding surfaces can thus be further improved.

Moreover, according to this embodiment, the peripheral wall of the third bore 101*b*3 is partly or wholly integral with the formation wall of each cylinder bore. With such a structure, the peripheral wall of the third bore 101*b*3 is situated farthest from the drive shaft 110 in the radial outside, so that oil easily spreads directly to the sliding surfaces of the swash plate 111 on the compression stroke side and the shoes 137. The lubrication of the sliding surfaces can thus be further improved.

Moreover, according to this embodiment, the first path 145*a* opening to the second bore 101*b*2 includes the guide path 145*a*1 that is directed toward the radial center area of the second bore 101*b*2 and axially inclined to approach the open end of the second path 145*b*. With such a structure, the guide path 145*a*1 guides main flow of discharge gas toward the open end of the second path 145*b*, and oil easily flows into the second path 145*b*.

Moreover, according to this embodiment, the second bore 101*b*2, the second path 145*b*, and the third path 145*c* constitute a common path with the pressure release path 146, and the second bore 101*b*2 is a space of branching between the pressure supply path 145 and the pressure release path 146. The control valve 300 is positioned in the middle of the first path 145*a*, and the orifice (throttle) 103*c* is provided in the middle of the pressure release path 146 communicating between the second bore 101*b*2 and the suction chamber 141. With such a structure, the lubrication of the sliding surfaces of the swash plate 111 on the compression stroke side and the shoes 137 is improved, and oil is prevented from flowing out of the compressor. This contributes to improved performance of the air conditioning system.

Moreover, according to this embodiment, the pressure release path 146 communicating between the second bore 101*b*2 and the suction chamber 141 opens to the surface on the valve plate 103 side at a position radially inside of the peripheral wall of the second bore 101*b*2 and away from the extension area of the guide path 145*a*1. With such a structure, oil included in discharge gas is prevented from directly flowing into the suction chamber 141.

This first embodiment describes the structure for more effectively flowing oil in refrigerant gas into the crank chamber 140 for improved lubrication. Depending on the model of the variable displacement compressor 100, however, oil tends to accumulate in the crank chamber 140. In such a case, if the effect of flowing oil into the crank chamber 140 is too high, oil is excessively retained in the crank chamber 140, causing the rotational resistance of the swash plate 111 to increase. This may lead to a decrease in efficiency of the compressor.

Figure 6:
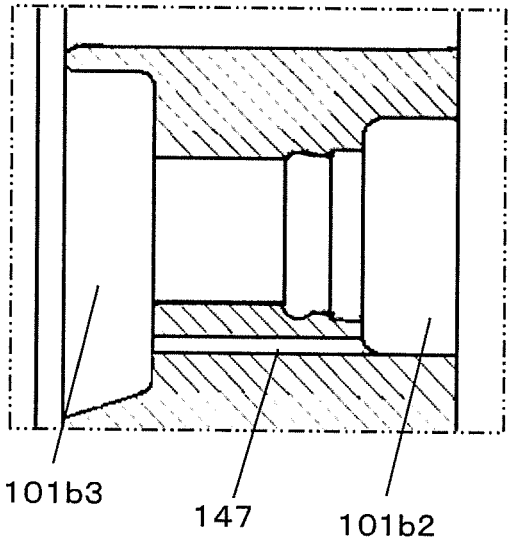
FIG. 6 is a longitudinal sectional view illustrating the main part of a variable displacement compressor according to a second embodiment of the present invention.

Such a compressor may be provided with a bypass path 147 for adjusting an amount of oil retained in the crank chamber 140 in order to prevent an excessive amount of oil in the crank chamber 140, as illustrated in FIG. 6 as an example.

According to this second embodiment with this structure, excess oil is smoothly discharged into the suction chamber 141 through the bypass path 147 having no centrifugal action unlike the third path 145*c*, so that oil retained in the crank chamber 140 can be maintained at a proper level.

The bypass path 147 is in parallel with the second path 145*b* and the third path 145*c*, and communicates between the third bore 101*b*3 and the second bore 101*b*2. The minimum path cross sectional area of the bypass path 147 is adjusted to control oil remaining in the crank chamber 140 within a proper range. Since only excess oil in the crank chamber 140 needs to be discharged, the minimum path cross sectional area of the bypass path 147 is smaller than the minimum path cross sectional area of each of the second path 145*b* and the third path 145*c*.

The illustrated embodiments are merely examples of the present invention, and the present invention includes not only the features directly indicated by the described embodiments but also various improvements and modifications made by a person skilled in the art within the scope of the claims.

For example, a part of the opening of the third path 145*c* may be situated between the crank chamber 140 and the axial position of the end surface of the cylinder bore 101*a* on the crank chamber 140 side, so long as the axis of the third path 145*c* is in the third bore 101*b*3.

Although only one third path 145*c* is provided in the foregoing embodiments, a plurality of third path 145*c* may be provided.

In addition, the positions (opening positions) of the plurality of third paths 145*c* in the axial direction of the drive shaft 110 may be different. The oil spray range can be widened coaxially.

Furthermore, since the opening of the third path 145*c* rotates together with the swash plate 111, the opening of the third path 145*c* may be pointed at a specific position in the swash plate 111.

Although the path common to the pressure supply path 145 and the pressure release path 146 is formed in the embodiments, the pressure supply path and the pressure release path may be separately formed in the variable displacement compressor.

In the case in which a stopper of the inclining spring formed on the drive shaft is provided in the crank chamber as described in Patent Document 1, the third path may open into the crank chamber between the stopper and the bottom surface of the cylinder block, without the third bore. The opening of the third path is kept from being blocked by the swash plate.

The present invention may also be applied to the structure in which the discharge chamber is in the center part of the cylinder head and the suction chamber is in the annular part outside the center part. In such a case, the center bore is formed as in the foregoing embodiments, the guide path (145*a*1) communicates with the suction chamber via a throttle, and the fourth path (145*d*) communicates with the discharge chamber in the center part. The same effect of preventing oil included in discharge gas which has flowed into the second bore 101*b*2 from directly flowing out of the guide path (145*a*1) can be achieved in this way. In the case in which the pressure release path and the pressure supply path are separately formed, the end surface of the drive shaft on the valve plate side may be brought closer to the valve plate to join the end surface of the adjusting screw to the valve plate so that the second path communicates via a through hole formed in the valve plate and communicating with the discharge chamber and via the through hole of the adjusting screw (the first bore is extended while the second bore is omitted).

The present invention is applicable to all reciprocating variable displacement compressors. For example, in a case in which the present invention is applied to an oscillation plate type compressor in which a back surface of an oscillation plate that is connected to a piston rod and oscillates in the axial direction of a drive shaft is slidably joined to a rotating swash plate, lubrication performance can be enhanced by effectively supplying oil to a sliding surface of a pivot support between the piston rod and the oscillation plate radially outwardly away from the drive shaft and an outer peripheral sliding surface with high sliding speed between the swash plate and the oscillation plate.

REFERENCE SYMBOL LIST

100 Variable displacement compressor
101 Cylinder block
101*a* Cylinder bore
101*b* Center bore
101*b*1 First bore
101*b*2 Second bore
101*b*21 Peripheral wall of second bore
101*b*3 Third bore
101*b*31 Bottom wall of third bore
101*b*32 Peripheral wall of third bore
101*b*33 Recess of third bore
102 Front housing
103 Valve plate
104 Cylinder head
110 Drive shaft
111 Swash plate
112 Rotor
120 Link mechanism
131 Plain bearing
132*a* Through hole of thrust plate
135*a* Through hole of adjusting screw
136 Piston
137 Shoe
140 Crank chamber
141 Suction chamber
142 Discharge chamber
145 Pressure supply path
145*a* First path
145*a*1 Guide path
145*b* Second path
145*c* Third path
146 Pressure release path

The invention claimed is:

1. A variable displacement compressor comprising:

a cylinder block in which a plurality of cylinder bores arranged annually and a center bore positioned within the plurality of cylinder bores are formed;

a front housing that blocks one end of the cylinder block, and defines a crank chamber together with the cylinder block;

a valve plate that blocks the other end of the cylinder block, and in which a discharge hole and a suction hole communicating with each of the plurality of cylinder bores are formed;

a cylinder head that is provided opposite to the cylinder block with the valve plate in between, and in which one of a suction chamber and a discharge chamber is formed in a center part and the other one of the suction chamber and the discharge chamber is formed in an annular part outside the center part, the suction chamber communicating with a suction-side external refrigerant circuit, and the discharge chamber communicating with a discharge-side external refrigerant circuit;

a piston that is disposed in each of the plurality of cylinder bores, and reciprocates in an axial direction of a drive shaft;

the drive shaft one end of which is inserted into the center bore, and that is radially supported by the cylinder block via a plain bearing;

a rotor that is fixed to the drive shaft, and rotates integrally with the drive shaft;

a swash plate that is connected to the rotor via a connecting unit, and slidably attached to the drive shaft so that the swash plate has a variable inclination angle with respect to an axis of the drive shaft when rotating synchronously with the rotor;

a conversion mechanism that converts rotation of the swash plate into reciprocation of the piston;

a pressure supply path that communicates between the discharge chamber and the crank chamber;

a control valve that adjusts an opening of the pressure supply path; and a pressure release path that communicates between the crank chamber and the suction chamber, wherein a pressure in the crank chamber is changed by adjusting the opening by the control valve to change the inclination angle of the swash plate and adjust a stroke of the piston, and a refrigerant sucked into the cylinder bore from the suction chamber is compressed and discharged into the discharge chamber, wherein a downstream part of the pressure supply path includes:

an upstream path formed inside the drive shaft and being along a center axis of the drive shaft; and a downstream path intersecting and connecting to the upstream path inside the drive shaft, and having an open end communicating with the crank chamber, wherein the center bore includes:

a first bore that supports the plain bearing;

a second bore that is positioned between the first bore and the valve plate and positioned in a manner such that a peripheral wall thereof on a valve plate side is radially outside of the first bore; and a third bore that is connected to the crank chamber and positioned in a manner such that a peripheral wall thereof is radially outside of the first bore, the third bore having a bottom wall connecting the peripheral wall and the first bore, wherein the pressure supply path includes:

the second bore;

a first path that communicates between the second bore and the discharge chamber;

a second path that communicates with the second bore, and is formed inside the drive shaft so as to extend from one end surface of the drive shaft toward the center axis of the drive shaft to constitute the upstream path; and a third path that is substantially orthogonally communicated to the second path inside the drive shaft and opens to an outer peripheral surface of the drive shaft, and communicates with the crank chamber to constitute the downstream path, and wherein a position of an axis of the third path in the axial direction of the drive shaft is in the third bore and near an axial position of an end surface of the cylinder bore on a crank chamber side, and the third path opens to the peripheral wall of the third bore.

2. The variable displacement compressor according to claim 1, wherein a length of the third bore in the axial direction of the drive shaft is less than a length of each of the first bore and the second bore in the axial direction.

3. The variable displacement compressor according to claim 1, wherein an inclined area, of which the distance from the drive shaft increases with a decreasing distance from the crank chamber, is formed in the peripheral wall of the third bore.

4. The variable displacement compressor according to claim 1, wherein a recess, of which the distance from the drive shaft increases, is formed in the peripheral wall of the third bore, and the recess is situated between adjacent ones of the plurality of cylinder bores.

5. The variable displacement compressor according to claim 1, wherein at least a part of the peripheral wall of the third bore is integral with a formation wall of the cylinder bore.

6. The variable displacement compressor according to claim 1, wherein the first path opening to the second bore includes a guide path that is directed toward a radial center area of the second bore and axially inclined to approach an open end of the second path.

7. The variable displacement compressor according to claim 1, wherein the second bore, the second path, and the third path constitute a common path with the pressure release path, the second bore is a space of branching between the pressure supply path and the pressure release path, the control valve is positioned in the middle of the first path, and a throttle is provided in the middle of the pressure release path communicating between the second bore and the suction chamber.

8. The variable displacement compressor according to claim 7, wherein the pressure release path communicating between the second bore and the suction chamber opens to a surface on the valve plate side at a position radially inside of the peripheral wall of the second bore and away from an extension area of the guide path.

9. The variable displacement compressor according to claim 7, wherein a bypass path communicating between the second bore and the third bore is formed in parallel with the second path and the third path, and a minimum cross sectional area of the bypass path is smaller than a minimum cross sectional area of each of the second path and the third path.

* * * * *